US006751932B1

(12) United States Patent
Matthews

(10) Patent No.: US 6,751,932 B1
(45) Date of Patent: Jun. 22, 2004

(54) METHOD FOR ATTACHING RECLOSABLE ZIPPER STRIP TRANSVERSELY TO A SHEET OF THERMOPLASTIC FILM MATERIAL

(75) Inventor: David J. Matthews, Gilman, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/370,407

(22) Filed: Feb. 19, 2003

(51) Int. Cl.[7] ..... B65B 61/18
(52) U.S. Cl. ..... 53/412; 53/133.4
(58) Field of Search ..... 53/412, 133.4, 53/139.2; 493/213, 214, 927; 156/66

(56) References Cited

U.S. PATENT DOCUMENTS 5,557,907 A 9/1996 Malin et al.
5,592,802 A 1/1997 Malin et al.
5,638,586 A 6/1997 Malin et al.
5,823,933 A * 10/1998 Yeager ..... 493/213
6,017,412 A 1/2000 Van Erden et al.
6,044,621 A 4/2000 Malin et al.
6,088,998 A 7/2000 Malin et al.
6,098,369 A * 8/2000 Bodolay et al. ..... 53/133.4
6,115,892 A 9/2000 Malin et al.
6,131,370 A 10/2000 Ausnit
6,151,868 A 11/2000 Matthews
6,167,597 B1 1/2001 Malin
6,308,498 B1 10/2001 Malin
6,517,473 B1 * 2/2003 Cappel ..... 493/213
6,526,726 B1 * 3/2003 Strand et al. ..... 53/412
6,539,691 B2 * 4/2003 Beer ..... 53/133.4
6,588,176 B1 * 7/2003 Buchman ..... 53/412

* cited by examiner

*Primary Examiner*—John Sipos
(74) *Attorney, Agent, or Firm*—Pitney Hardin LLP

(57) ABSTRACT

A method for attaching a reclosable zipper strip (40) onto a sheet of thermoplastic film material (32) in the production of packages includes an apparatus (10) which has two guide plates (12, 14) that define a guide space (16). The apparatus (10) includes a pair of hole punches (26), one on either side of the guide space (16), and;a knife (24) which severs lengths of the zipper strip (40) in the guide space. The hole punches (26) and the cutting knife (24) are separated from one another by a distance equal to the length of the zipper strip (40) being attached to the sheet (32). The hole punches remove the flanges (54, 56, 58) from a preselected amount of the zipper strip (40) upstream of the knife (24).

11 Claims, 5 Drawing Sheets

METHOD FOR ATTACHING RECLOSABLE ZIPPER STRIP TRANSVERSELY TO A SHEET OF THERMOPLASTIC FILM MATERIAL

FIELD OF THE INVENTION

The present invention relates to reclosable plastic bags of the type in which consumer products are packaged for retail sale. More particularly, the present invention relates to reclosable plastic bags manufactured and filled on packaging machines using a sheet of thermoplastic film material having lengths of reclosable zipper strip attached transversely thereto at package-length intervals.

DESCRIPTION OF THE PRIOR ART

The present invention relates to improvements in the package-making art and may be practiced in the manufacture of thermoplastic bags and packages of the kind that may be used for various consumer products, but which are particularly useful for food products which must be kept in moisture-tight and air-tight packages, free from leakage until initially opened for access to the package contents, and which are then reclosable by a zipper to protect any remainder of the product therein. The prior art is fairly well developed, but nevertheless has aspects worthy of improvement and refinement.

In the present case, lengths of reclosable zipper, strip are applied to a sheet of thermoplastic film advancing longitudinally therealong with the zipper strip applied transversely at package-length intervals. In the prior art, the required lengths of reclosable zipper strip are separated from a supply thereof by a cutting knife which passes through a gap in the plates used to guide the strip. Frequently, as the subsequent length of reclosable zipper strip is advanced past the gap, the strip becomes misaligned, jams or otherwise misfeeds across the gap. Such events require production to be halted while the zipper strip is correctly re-fed past the gap. The present invention provides a solution to this problem.

SUMMARY OF THE INVENTION

Accordingly, the present invention is a method for attaching a reclosable zipper strip transversely to a sheet of thermoplastic film material for use in the production of plastic bags or packages. The sheet itself has a longitudinal direction and, is incrementally advanced in that direction in amounts equal in length to that of the bags or packages being manufactured. A length of the reclosable zipper strip is transversely attached to each incremental length of the sheet.

The method starts with the step of providing a reclosable zipper strip having a male interlocking profile and a female interlocking profile. The male interlocking profile has a male interlocking member, while the female interlocking profile has a female interlocking member. One of the male and female interlocking profiles has a web integrally formed with its respective interlocking member on both lateral sides thereof. The other of the male and female interlocking profiles has a web integrally formed with its respective interlocking member on at least one lateral side thereof.

The method further includes the step of removing preselected amounts of the webs from the reclosable zipper strip at preselected intervals therealong, leaving only the interlocked male and female interlocking members at those preselected intervals. The method continues with the step of guiding the reclosable zipper strip into position for transverse attachment onto the sheet. The interlocked male and female interlocking profiles are then cut where the preselected amounts of the webs have been removed to provide desired lengths of the reclosable zipper strip. These lengths are then transversely attached onto the sheet of thermoplastic film material at package-length intervals therealong. Preferably, these lengths are attached so that they are centered on the sheet of thermoplastic film material.

The sheet of thermoplastic film material with lengths of reclosable zipper strip attached transversely thereto may either be rolled up for use at a subsequent time or fed directly to a package-making machine, such as a vertical form-fill-and-seal (VFFS) machine, to make reclosable packages and/or to fill them with a consumer product.

The production of such packages includes the additional steps of folding the sheet of thermoplastic film material so as to bring its lateral edges together, and of sealing the lateral edges to each other to form a package having front and back walls. The thermoplastic film material of the front and back walls is then sealed above and below the ends of the lengths of reclosable zipper strip where the webs have been removed to entrap the two ends of the reclosable zipper strip without having to crush them.

Finally, the webs of the male and female interlocking profiles are sealed to the thermoplastic film material without sealing them to each other, cross-seals are formed at the top of the package and at the bottom of the succeeding package, and the thermoplastic film material is cut between the cross-seals to separate a completed package from the sheet of thermoplastic film material.

The present invention also encompasses an apparatus for attaching lengths of reclosable zipper strip to thermoplastic film material. The apparatus comprises a first guide plate and a second guide plate. The first and second guide plates are separated from each other by a guide space and have first and second ends. The first guide plate is longer than the second guide plate so that the first end of the first guide plate is offset from the first end of the second guide plate.

The apparatus also comprises a cutting knife disposed over the guide space adjacent to the first end of the second guide plate. The cutting knife is adapted to cut the reclosable zipper strip being conveyed along the guide space.

The apparatus further comprises a first hole punch and a second hole punch which are across the guide space from each another on the first guide plate and second guide plate, respectively. The first and second hole punches are at a preselected distance along the first and second guide plates from the cutting knife. The first and second hole punches are adapted to remove preselected amounts of the flanges of the reclosable zipper strip.

The apparatus finally includes means for feeding reclosable zipper strip into the guide space, and a seal bar and an anvil which seal the leading flange of the web of one of the male and female interlocking profiles to the sheet of thermoplastic film material.

BRIEF DESCRIPTION OF THE DRAWINGS

Further objects and advantages of the invention will be apparent from the following description and claims.

DETAILED DESCRIPTION OF THE PREFERRED EMBODIMENTS

Figure 1:
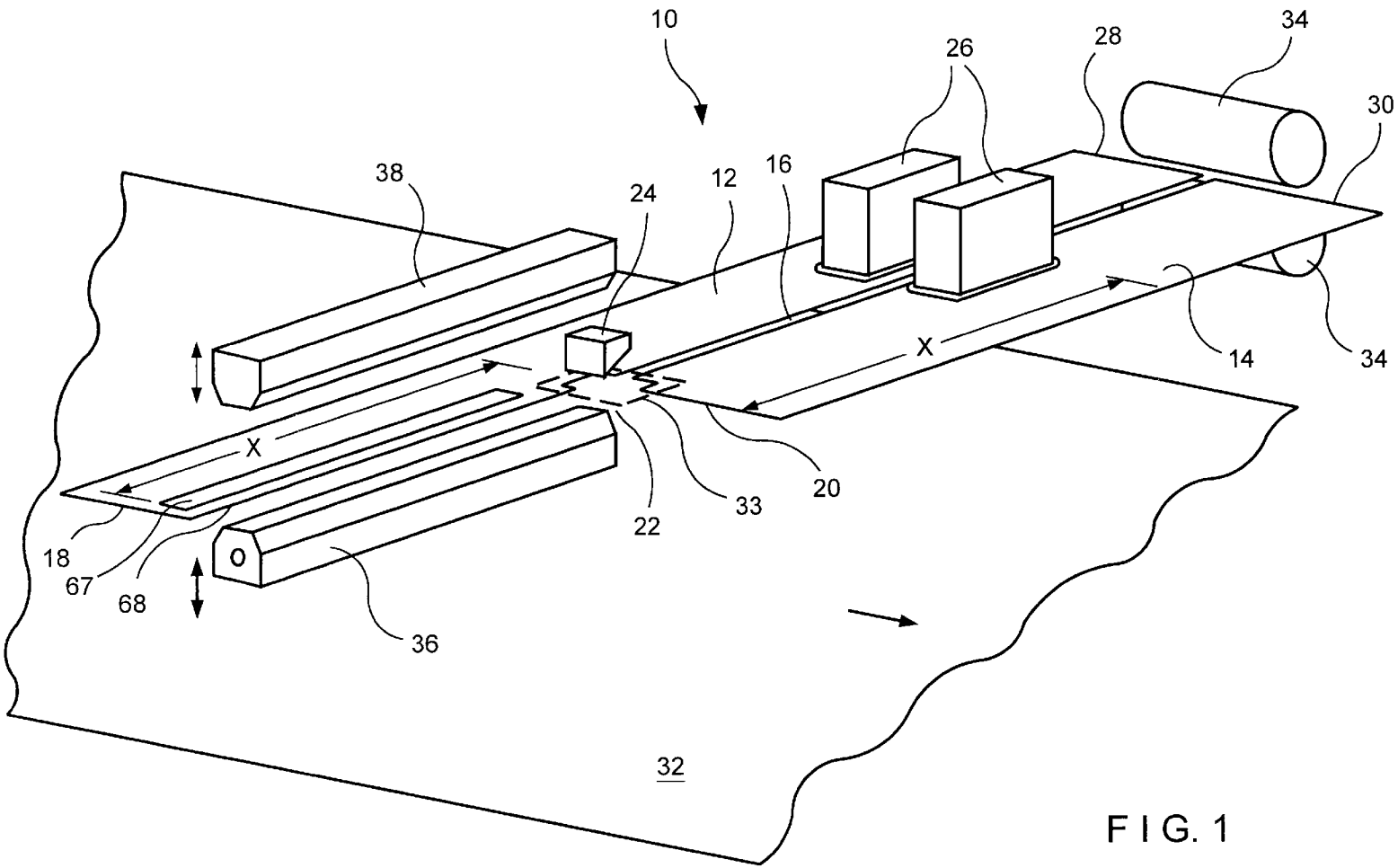
FIG. 1 is a perspective view of an apparatus for attaching reclosable zipper strip transversely onto a sheet of thermoplastic film material.

Referring now to the drawings in detail in which like numerals indicate like elements throughout the several views, FIG. 1 is a perspective view of an apparatus 10 for attaching lengths of reclosable zipper strip transversely at package-length intervals on a sheet 32 of thermoplastic film material. Apparatus 10 comprises a first guide plate 12 and a second guide plate 14, which are separated from one another by a guide space 16. First guide plate 12 is longer than second guide plate 14 by at least a preselected amount "x", in which amount "x" is equal to the length of the reclosable zipper strip to be transversely applied at package-length intervals to the sheet 32. At a point on the first and second guide plates 12, 14 coinciding with the first end 20 of the second guide plate 14 is an opening 22, which is somewhat wider than guide space 16 in order to accommodate cutting knife 24 which severs the zipper strip at intervals equal in length to the amounts being applied to the sheet 32, that amount being equal in length to the preselected amount "x". Beneath the opening 22 and above the sheet 32 is a strike plate 33 which prevents the cutting knife 24 from severing the sheet when the cutting knife severs the zipper strip 40. The strike plate 33 may be attached to the guide plates 12, 14 or alternatively affixed by any other component without interfering with the movement of the zipper strip 40.

At the same preselected amount "x", along the first: and second guide plates 12, 14 from opening 22, are hole punches 26, which trim the leading and trailing flanges from the webs of the reclosable zipper strip at equivalent intervals therealong for reasons that will be made clear in the following discussion.

Adjacent to the second ends 28, 30 of the first and second guide plates 12, 14, respectively, are a pair of servo rollers 34, which measure out the reclosable zipper strip, at lengths equal to the preselected amount "x" from a source, such as a spool, not shown in FIG. 1, and direct it into and along the guide space 16.

To complete the description of the apparatus 10, a seal bar 36 is disposed below and downstream of first guide plate 12 relative to the movement,in package-length increments, of sheet 32 through apparatus 10. Seal bar 36 extends parallel to the first guide plate 12 in the space between the first end 18 of the first guide plate 12 and the first end 20 of the second guide plate 14. Above the seal bar 36 is an anvil 38, which is also downstream of the first guide plate 12. The seal bar 36 and the anvil 38 reciprocate vertically, as indicated by the double-headed direction arrows beside them in FIG. 1, during the operation of the apparatus 10. The sheet 32 of thermoplastic film material runs beneath the first and second guide plates 12, 14 and the anvil 38 and above the seal bar 36 toward the night, as indicated by the direction arrow on the sheet 32 in FIG. 1, during the operation of the apparatus 10.

Figure 2:
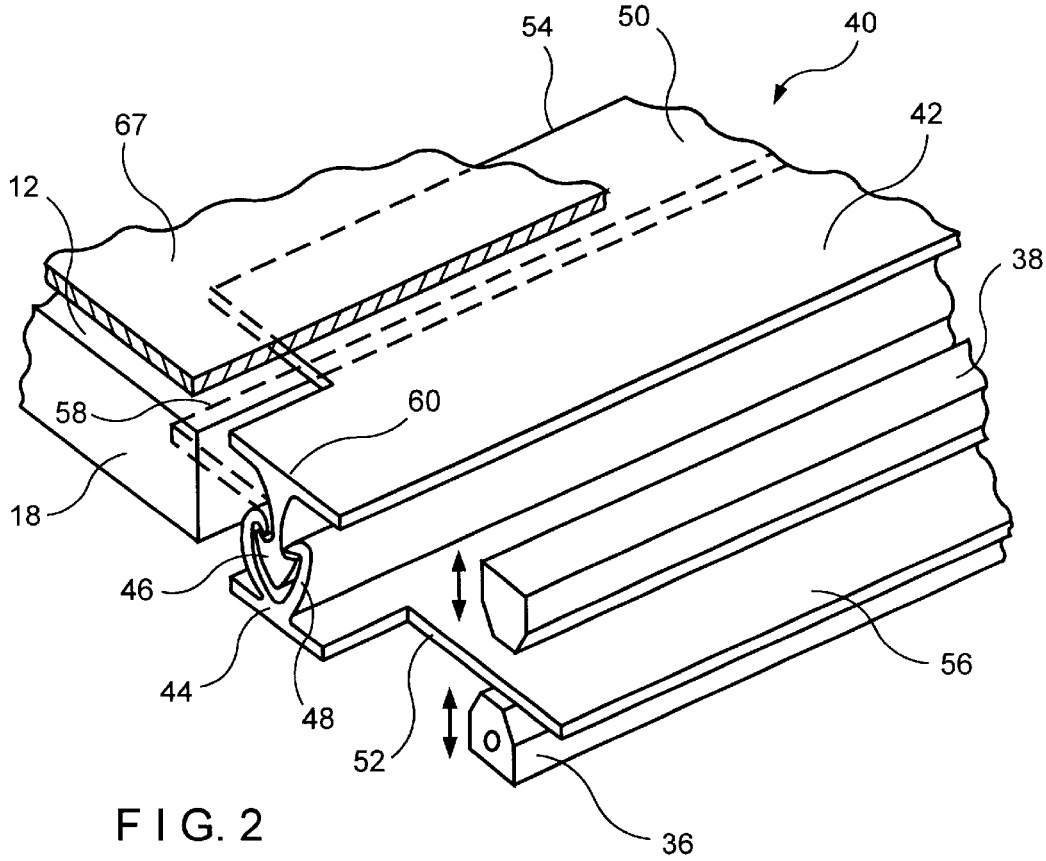
FIG. 2 is a perspective view of an end of the apparatus showing a reclosable zipper strip therein.
Figure 3:
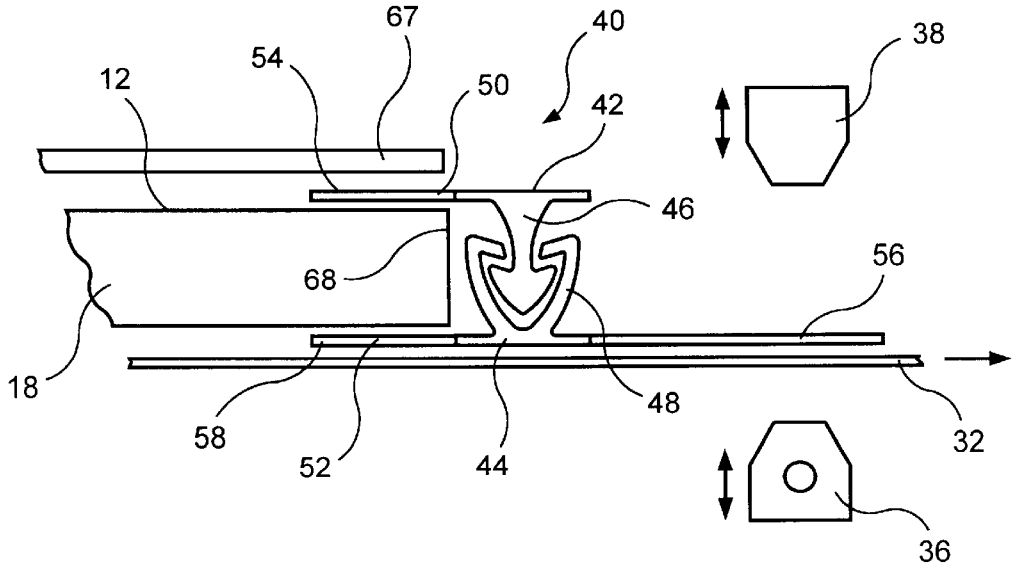
FIG. 3 is an end view of the apparatus corresponding to the view of FIG. 2.

FIG. 2 is a schematic perspective view of the first end 18 of first guide plate 12 of apparatus 10 showing the manner in which the first guide plate 12 guides a reclosable zipper strip 40. FIG. 3 is an end view corresponding to the view in FIG. 2 and showing the manner in which the sheet 32 is sealed to the reclosable zipper strip 40.

Referring to both figures, reclosable zipper strip 40 comprises a male interlocking profile 42 and a female interlocking profile 44. The male interlocking profile 42 has a male interlocking member 46 which may have an arrowhead-shaped cross-section, as shown in FIGS. 2 and 3. The female interlocking profile 44 has a female interlocking member 48 comprising two inwardly curving members having barbed edges forming a receptacle or channel into which male interlocking member 46 may be snappingly engaged. It should be understood that these configurations for the male and female interlocking members 46, 48 are only examples of such interlocking members, and that there is no intention on the part of the inventor to limit the present invention to reclosable zipper strips of the specific variety shown.

Both the male and female interlocking profiles 42, 44 include webs 50, 52, respectively, which may be coextruded with the male and female interlocking members 46, 48 or extruded separately and later attached. As illustrated, the web 50 on the male interlocking profile 42 has only a trailing flange 54, so called because it is oriented upstream with respect to the movement of the sheet 32 of thermoplastic film material to which the reclosable zipper strip 40 is being attached.

On the other hand, the web 52 on the female interlocking profile 38 has both a leading flange 56 and a trailing flange 58. The leading flange 56 is so called because it is oriented downstream with respect to the movement of the sheet 32 to which the reclosable zipper strip 40 is being attached. Ultimately, as will be seen below, the leading flange 56 will reside inwardly of the mouth of the plastic bag or package to be manufactured. Male interlocking profile 42 may also have a leading flange, although its presence may cause some guidance problems at the collar of a vertical form-fill-and-seal (VFFS) ,machine if such a machine is used to manufacture the packages.

The guide space 16 between the first and second guide plates 12, 14 is of a width to accommodate the male and female interlocking members 46, 48. Moreover, the first and second guide plates 12, 14 are of a thickness sufficient to maintain the webs 50, 52 in a condition parallel to one another as they guide the reclosable zipper strip 40 on the apparatus 10. That is to say, more specifically, the first and second guide plates 12, 14 are of substantially the same thickness as the interlocked male and female interlocking members 46, 48, so that they guide the reclosable zipper strip 40 on the apparatus 10 in a stable manner. In addition, the first guide plate 12 is also of sufficient thickness to guide reclosable zipper strip 40 alone between opening 22 and the first end 18 thereof, where the webs 50, 52 on either side of the first guide plate 12 along with a third guide plate 67 keep reclosable zipper strip 40 from misaligning during attachment or slipping off the lateral edge 68 of the first guide plate 12.

Referring to FIG. 3, which includes the sheet 32 of thermoplastic film material not shown in FIG. 2, the seal bar 36 attaches lengths of the reclosable zipper strip 40 to sheet 32. The anvil 38 acts as a stable backing support when both the seal bar 36 and the anvil 38 clamp toward each other to seal the leading flange 56 of the female interlocking profile 44 to the sheet 32. If the male interlocking profile 42 has a leading flange, the sealing has to be done in a manner that will not leave the two leading flanges, one of them being leading flange 56, sealed to each other. Similarly, if either the male interlocking profile 42 or the female interlocking profile 44 has a flange that is longer than the flange of the other interlocking profile, the sealing has to be done in a manner that will not leave both flanges sealed to the film and/or to each other.

Figure 4:
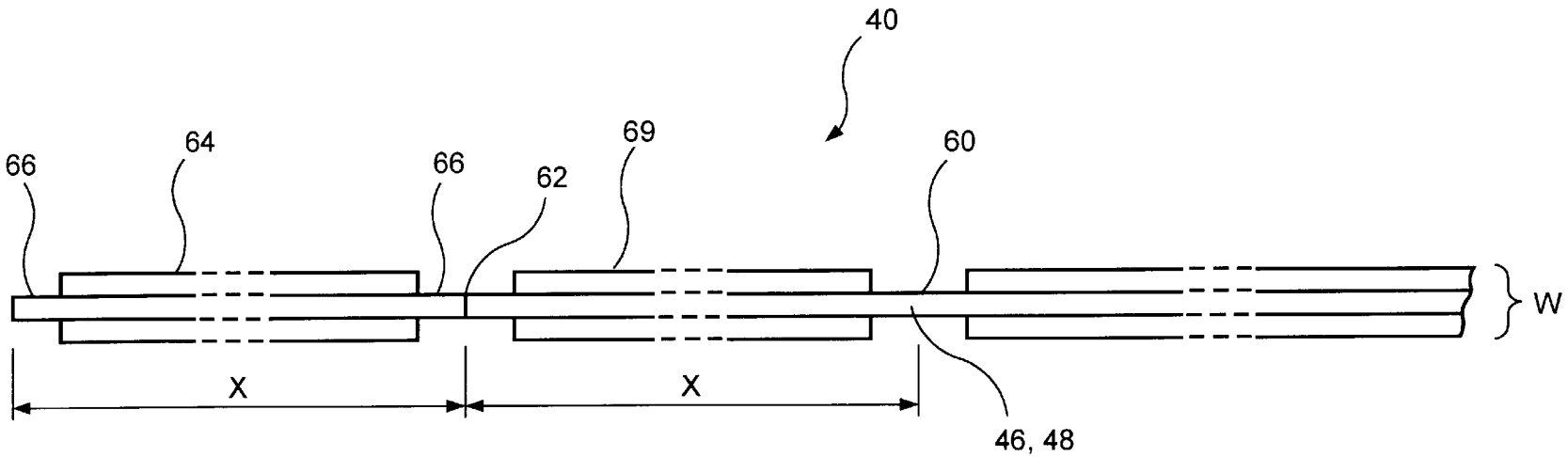
FIG. 4 is a plan view of a reclosable zipper strip as it would appear if removed from the apparatus during its operation.

FIG. 4 is a plan view of the reclosable zipper strip 40 as it would appear if removed from apparatus 10 at some time during its operation. As discussed above, the reclosable zipper strip 40 is measured out by the servo rollers 34 in increments equal to the preselected amount "x". After each increment of this length is directed into the guide space 16, the hole punches 26 remove the leading and trailing flanges 54, 56, 58, as indicated at point 60 in FIG. 4, leaving just the interlocked male and female interlocking members 46, 48. In addition, the cutting knife 24 severs the interlocked male and female interlocking members 46, 48 at point 62 to detach an increment 64 of reclosable zipper strip 40 of the length "x". Each increment 64 of the length "x" has ends 66 which do not have flanges 54, 56, 58, these portions of the flanges having been removed by hole punches 26.

It is important to observe that the overall width "w" of the reclosable zipper strip 40 is greater than the width of the opening 22 where the interlocked male and female interlocking members 46, 48 are cut. Such a condition ensures that the reclosable zipper strip 40 will be able to pass the opening 22 without jamming after each increment 64 has been attached to sheet 32 and removed from the lateral edge 68 of the first guide plate 12 by the incremental movement of the sheet 32.

The sequence of steps by which apparatus 10 operates is as follows:

a) to initialize, a reclosable zipper strip 40 is advanced into the guide space 16 to a point adjacent the hole punches 26;

b) the hole punches 26 remove the flanges 54, 56, 58 from a first end of the reclosable zipper strip 40;

c) the reclosable zipper strip 40 is advanced into the guide space 16 by an increment 64 of length "x";

d) the hole punches 26 remove flanges 54, 56, 58 from the opposite end of the increment 64 of the reclosable zipper strip 40 and the first end of a follow-on increment 69;

e) the follow-on increment 69 of the reclosable zipper strip 40 is advanced into the guide space 16 by an increment 64 of length "x", pushing the previous increment 64 along the lateral edge 68 of the first guide plate 12;

f) the interlocked male and female interlocking profiles 42, 44 are cut by the cutting knife 24 to separate the previous increment 64 from the follow-on increment 69;

g) the sheet 32 of thermoplastic film material is fed beneath the first and second guide plates 12, 14 and between the seal bar 36 and the anvil 38;

h) the leading flange 56 of the female interlocking profile 44 is attached transversely to the sheet 32 by the seal bar 36 and the anvil 38, preferably with the interlocked male and female interlocking profiles 42, 44 being centered thereon;

i) the anvil 38 and seal bar 36 are separated;

j) the sheet 32 of thermoplastic film material is advanced downstream in a package-length amount, thereby removing the increment 64 of the interlocked male and female interlocking profiles 42, 44 from the lateral edge 68 of the first guide plate 12; and k) the sequence is repeated starting with the step e) above, in which the follow-on increment 69 becomes the increment 64 for attaching to the sheet 32 with a successive increment becoming the increment 69 being advanced to the guide space 16.

It should be noted that the cutting knife 24 severs the interlocked male and female interlocking profiles 42, 44 without cutting the sheet 32 of thermoplastic film material by blocking its cutting reach to the thermoplastic film with a strike plate 33.

The sheet 32 of thermoplastic film material with the lengths of reclosable zipper strip 40 attached transversely thereto may be either rolled up for use at a subsequent time or fed directly to a package-making machine, such as a vertical form-fill-and-seal (VFFS) machine, to make and/or fill reclosable packages with a consumer product.

Figure 5:
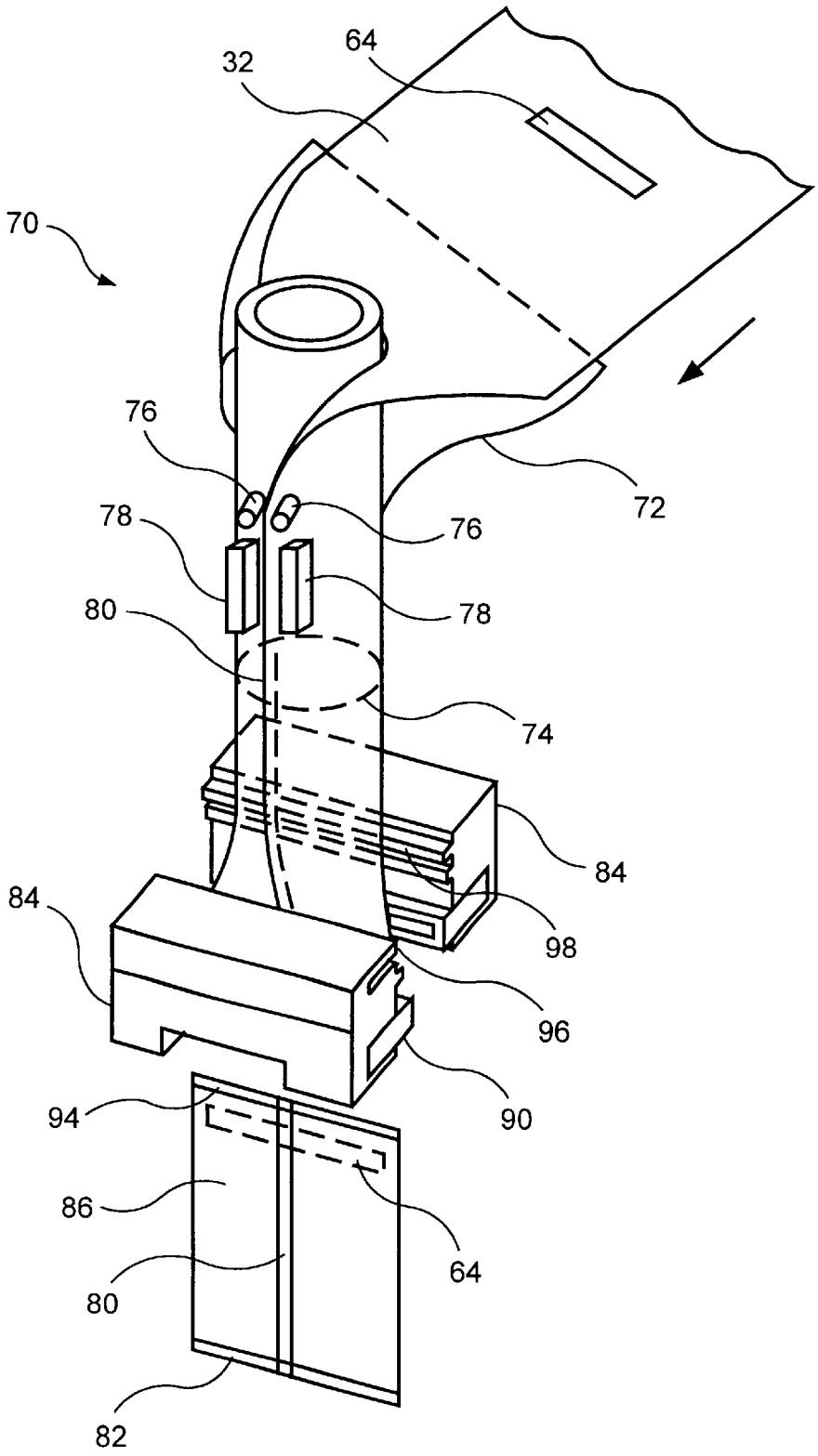
FIG. 5 is a perspective view of a vertical form-fill-and-seal (VFFS) machine.

FIG. 5 is a perspective view of a VFFS machine which can be used to make reclosable packages. It should be understood, however, that such a machine is only an example of the pouch-making or package-making machines with the which the present sheet 32 of thermoplastic film material having lengths of the reclosable zipper strip 40 attached thereto may be used to make reclosable packages, and that there is no intention on the part of the inventor to restrict the present invention to use with or on such a machine.

Referring to FIG. 5, the sheet 32 of thermoplastic film material with incremental lengths 64 of the reclosable zipper strip 40 attached to the center thereof is fed at package-length intervals either from a roll or directly from the apparatus 10, toward a VFFS machine 70. The sheet 32 is fed downwardly over the collar 72 and wrapped around the filling tube 74. The lateral edges of the sheet 32 are brought together and pressed together by a pair of rollers 76. The edges are then welded together by heater bars 78 to form a longitudinal back or fin seam 80. A consumer product may then be dropped through the filling tube 74 into the open package which has a bottom seal 82. As noted below, the bottom seal 82 is made when the top of the preceding package is sealed.

Figure 6:
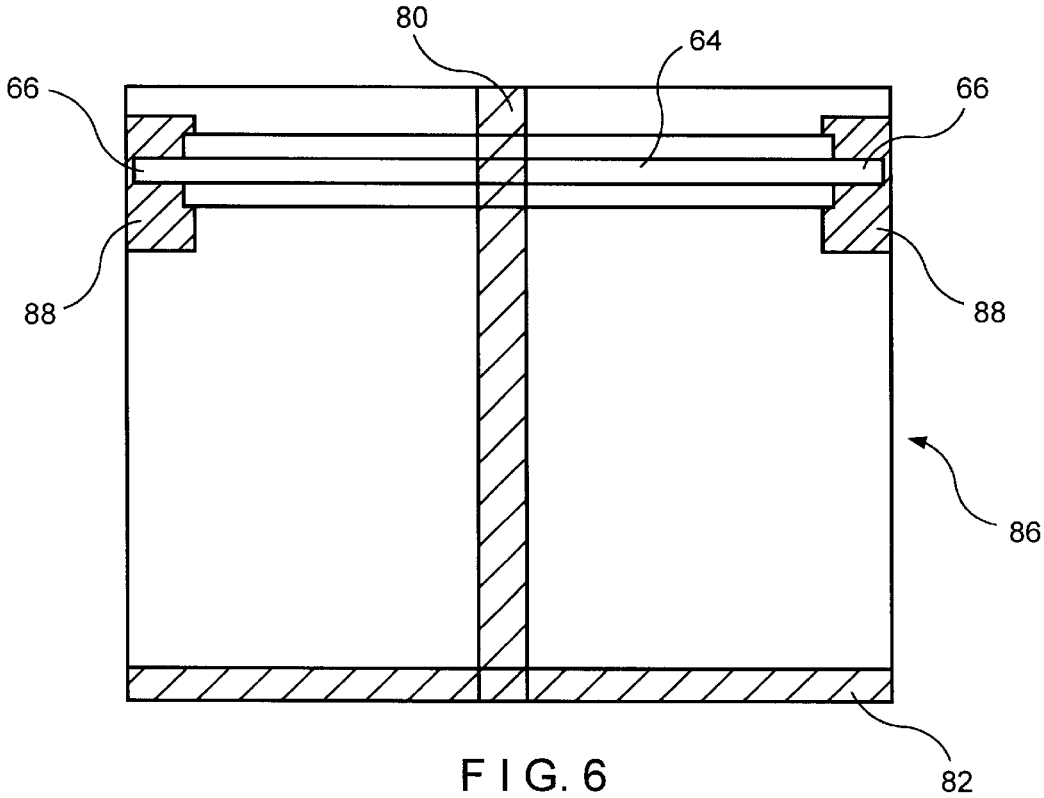
FIG. 6 is a plan view of a partially completed reclosable package.

After the consumer product has been dropped through the filling tube 74 into the open package, the top of the package is completed by the action of cross-seal jaws 84, which perform several separate functions. Firstly, referring to FIG. 6, which is a plan view of a partially completed package 86, the ends 66 of incremental length 64 of the reclosable zipper strip 40 are rendered immobile, that is, the interlocked male and female interlocking profiles 42, 44 are held in fixed positions, by spot seals 88 which encapsulate them within the sealed film area and prevent them from being separated and misaligned, but which do not seal or crush the ends 66 of the male and female interlocking members 46, 48.

Figure 7:
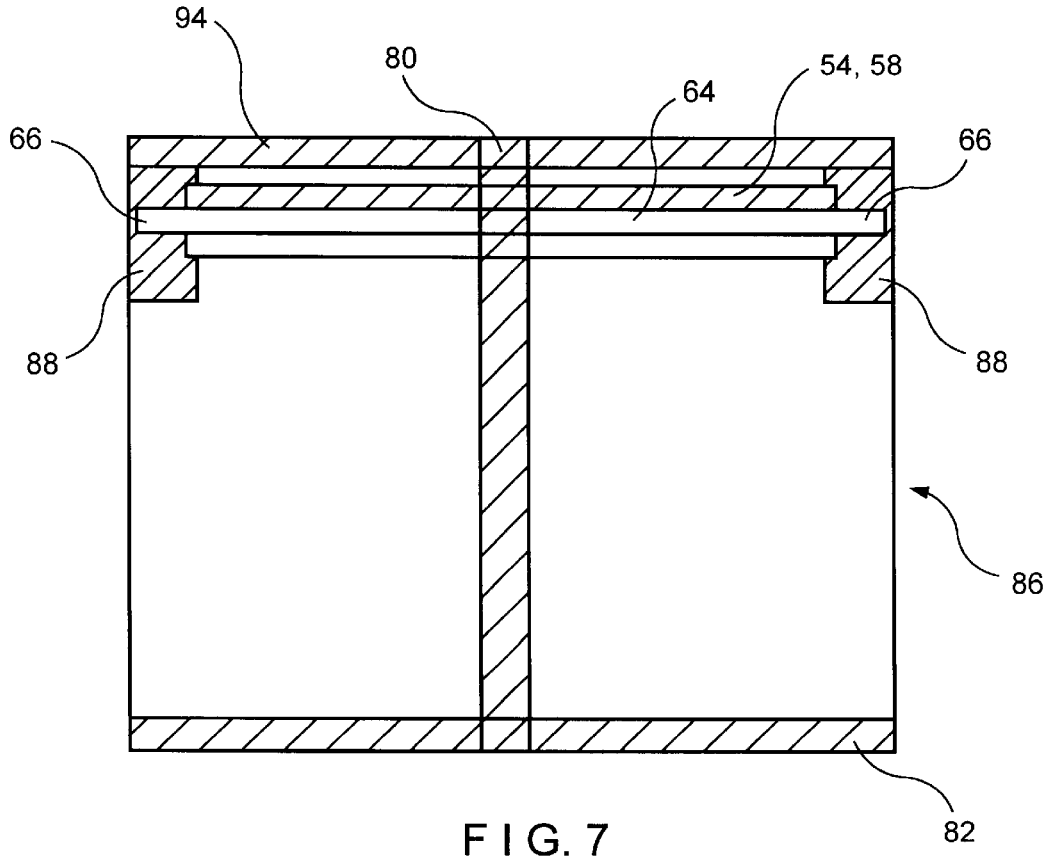
FIG. 7 is a view of the package of FIG. 6 when its manufacture has been completed.

Then, referring to FIG. 7, a plan view of a completed package 86, the cross-seal jaws 84, specifically integrated heater bars 90, seal the trailing flanges 54, 58 of the incremental length 64 of the reclosable zipper strip 40 to the sheet 32, specifically to the front and back of the package 86, without sealing the trailing flanges 54, 58 to each other. At the same moment, the heater bars 90 seal the front and back of the package over the ends 66 of the reclosable zipper strip 40 to form the spot seals 88. Next, integrated heater bars 92 seal the top of the package 86 to form a tamper-evident seal 94, while integrated heater bars 96 make the lower seal 82 for the next package 86. Finally, a knife 98 of the cross-seal jaws 84 cuts the bottom completed package 86 away from that immediately above it.

Modifications to the above would be obvious to those of ordinary skill in the art, but would not bring the invention so modified beyond the scope of the appended claims.

What is claimed is:

1. A method for attaching a reclosable zipper strip to a sheet of thermoplastic film material for use in the production of plastic bags or packages, said method comprising the steps of:

providing a reclosable zipper strip having a male interlocking profile and a female interlocking profile, said male interlocking profile having a male interlocking member and said female interlocking profile having a female interlocking member, one of said male and female interlocking profiles having a web integrally formed with its respective interlocking member on both lateral sides thereof and the other of said male and female interlocking profiles having a web integrally formed with its respective interlocking member on at least one lateral side thereof;

removing preselected amounts of said webs from said reclosable zipper strip at preselected intervals therealong; without removing any portion of said interlocking profile;

guiding said reclosable zipper strip into position for attachment onto said sheet;

cutting through said male and female interlocking profiles where said preselected amounts of said webs have been removed to provide desired lengths thereof; and attaching said desired lengths of said reclosable zipper strip onto said sheet of thermoplastic film material at package-length intervals therealong.

2. The method as claimed in claim 1 wherein said attaching step is performed with said desired lengths of said reclosable zipper strip attached transversely onto said sheet of thermoplastic film material.

3. A method as claimed in claim 2 wherein said attaching step is performed with said desired lengths of said reclosable zipper strip centered on said sheet of thermoplastic sheet material.

4. A method as claimed in claim 2 wherein said web of said one of said male and female interlocking profiles having said web on both lateral sides of its respective interlocking member has a leading flange, said leading flange being oriented in a direction of incremental movement of said sheet of thermoplastic film material, and a trailing flange being oriented in an opposite direction, and wherein said attaching step is performed on said leading flange.

5. A method as claimed in claim 3 wherein said web of said one of said male and female interlocking profiles having said web on both lateral sides of its respective interlocking member has a leading flange, said leading flange being oriented in a direction of incremental movement of said sheet of thermoplastic film material, and a trailing flange being oriented in an opposite direction, and wherein said attaching step is performed on said leading flange.

6. A method for making reclosable packages comprising the steps of:

providing a sheet of thermoplastic film material having a longitudinal direction and advancing said sheet in said longitudinal direction in amounts equal in length to that of said reclosable packages;

providing lengths of reclosable zipper strip having a male interlocking profile and a female interlocking profile, said male interlocking profile having a male interlocking member and said female interlocking profile having a female interlocking member, one of said male and female interlocking profiles having a web integrally formed with its respective interlocking member on both lateral sides thereof to provide a trailing flange and a leading flange and the other of said male and female interlocking profiles having a web integrally formed with its respective interlocking member on at least one lateral side thereof to provide a trailing flange;

removing a portion of said trailing and leading flanges from the one of said male and female interlockig profiles and from the trailing flanges of the other of said male and female profiles at the two ends of said lengths of reclosable zipper strip, without removing any portion of said interlocking profiles;

attaching one of said male and female interlocking profiles of said lengths of reclosable zipper strip upon said sheet at package-length intervals;

folding said sheet of thermoplastic film material so as to bring its lateral edges together;

sealing the lateral edges to one another to form a package having front and back walls;

sealing said thermoplastic film material to the other of said male and female interlocking profiles of said lengths of reclosable zipper strip;

cross-sealing said sheet of thermoplastic film material closed at the top of a package and at the bottom of a succeeding package; and cutting said thermoplastic film material between the cross-seals to separate a completed package from the sheet of thermoplastic film material.

7. The method as claimed in claim 6 wherein said attaching step is performed with said lengths of reclosable zipper strip attached transversely onto said sheet of thermoplastic film material.

8. The method as claimed in claim 7 wherein said thermoplastic film sealing step is performed with said front and back walls sealed above and below the two ends of said lengths of reclosable zipper strip to entrap said two ends of said lengths of reclosable zipper strip.

9. The method as claimed in claim 8 wherein said attaching step is performed by sealing said leading flange thereto, said leading flange being oriented in the direction of the incremental advance of said sheet.

10. The method as claimed in claim 9 wherein said sealing step of thermoplastic film to the other of said male and female interlocking profiles of said lengths of reclosable zipper strip includes sealing the trailing flanges of both profiles without sealing said trailing flanges to each other.

11. A method as claimed in claim 9 wherein said step of cross-sealing said sheet of thermoplastic film material forms a peel-seal.

* * * * *